United States Patent [19]

Wallis

[11] 4,377,100

[45] Mar. 22, 1983

[54] PUNCH RETAINER

[76] Inventor: Bernard J. Wallis, 25200 Trowbridge Ave., Dearborn, Mich. 48124

[21] Appl. No.: 236,025

[22] Filed: Feb. 19, 1981

[51] Int. Cl.[3] ..... B26F 1/14

[52] U.S. Cl. ..... 83/698; 279/77; 279/79

[58] Field of Search ..... 83/698; 279/22, 24, 279/29, 30, 77, 79, 80

[56] References Cited

U.S. PATENT DOCUMENTS

| | | | |
|---|---|---|---|
| 691,449 | 1/1902 | Craig | 279/80 |
| 1,809,237 | 6/1931 | Halborg | 279/79 X |
| 1,886,177 | 11/1932 | Gairing | 279/79 |
| 1,910,275 | 5/1933 | Alden | 83/698 X |
| 2,089,166 | 8/1937 | Reichhardt | 279/30 |
| 2,580,930 | 1/1952 | Kost | 279/79 X |
| 2,766,029 | 10/1956 | Bruestle | 83/698 X |
| 4,174,648 | 11/1979 | Wallis | 279/77 X |

*Primary Examiner*—James M. Meister

*Attorney, Agent, or Firm*—Barnes, Kisselle, Raisch, Choate, Whittemore & Hulbert

[57] ABSTRACT

A punch and retainer assembly wherein the punch has a non-circular punching end and a flattened surface at the upper end of its side wall. The punch also has an axially extending, radially inwardly inclined flat surface below the flattened side wall portion. The punch retainer includes a vertically movable latch having cylindrical surfaces adapted to engage the flat inclined surface on the punch and a flat inclined surface on the retainer in wedging relation to retain the punch within the retainer. Means are provided for permitting the punch to be inserted into the retainer only when the flattened surface thereof is aligned parallel with the axis of the latch. A strong leaf spring biases the latch downwardly into engagement with the flat inclined surface on the punch so that the cylindrical surface of the latch engages the flat inclined surface on the punch with line contact that is perpendicular to the vertical axis of the punch.

7 Claims, 3 Drawing Figures

PUNCH RETAINER

This invention relates to a punch retainer for use in stamping presses and, more particularly, to a punch retainer generally of the type disclosed in my U.S. Pat. No. 4,174,648, dated Nov. 20, 1979. In my aforesaid patent there is disclosed a punch retainer provided with a latch having cylindrically shaped, diametrically opposite ends which are adapted to tangentially engage in wedging relationship an inclined face on the punch and an inclined face of a recess within the punch retainer to firmly retain the punch in the retainer. The latch is urged into said tangential wedging engagement by means of a helical spring having one end bearing downwardly on the latch. While the arrangement shown in said prior patent is admirably suited for use with punches having a circular punching end, experience has shown that where the punch is provided with a non-circular punching end the latch may be slightly skewed with respect to the inclined faces on the punch and the recess so that the punch may be retained in a position wherein the non-circular punching end thereof is at least slightly rotated angularly from its intended, accurately oriented position.

The primary object of the present invention is to provide a punch and retainer assembly that is designed such that, when the punch is inserted into the retainer, it is automatically rotated to the desired accurately oriented position.

A further object of the invention resides in the provision of a punch and retainer assembly of economical construction with a minimum of simply-formed components.

Other objects, features and advantages of the present invention will become apparent from the following description and accompanying drawings, in which.

Figure 1:
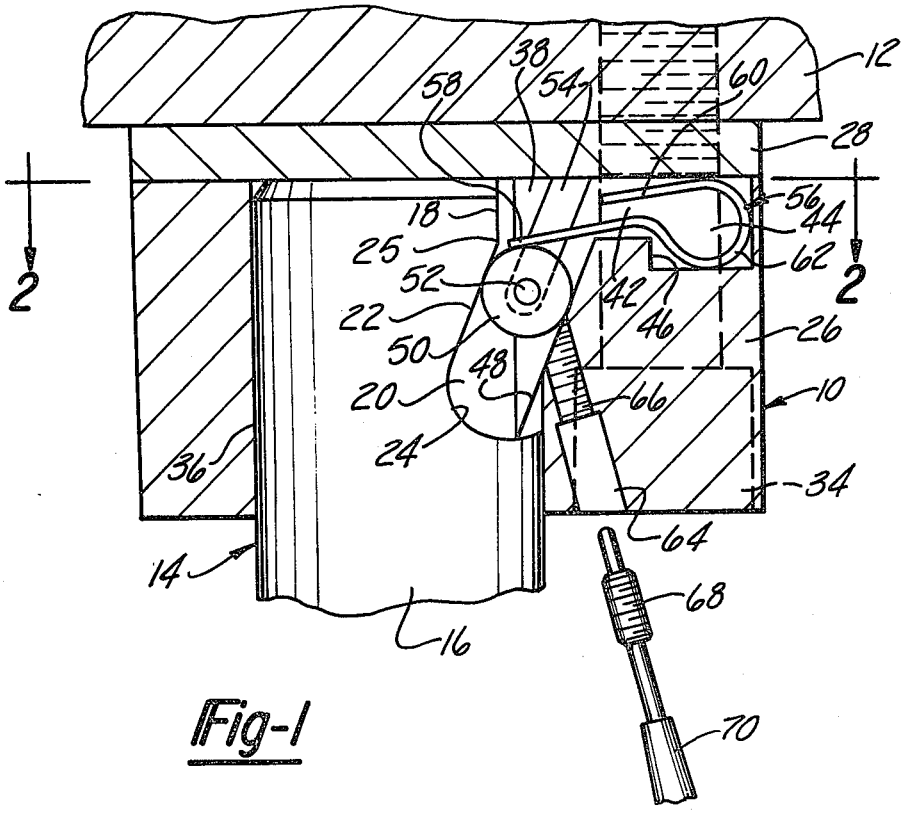
FIG. 1 is a vertical sectional view through a punch and retainer according to the present invention.
Figure 3:
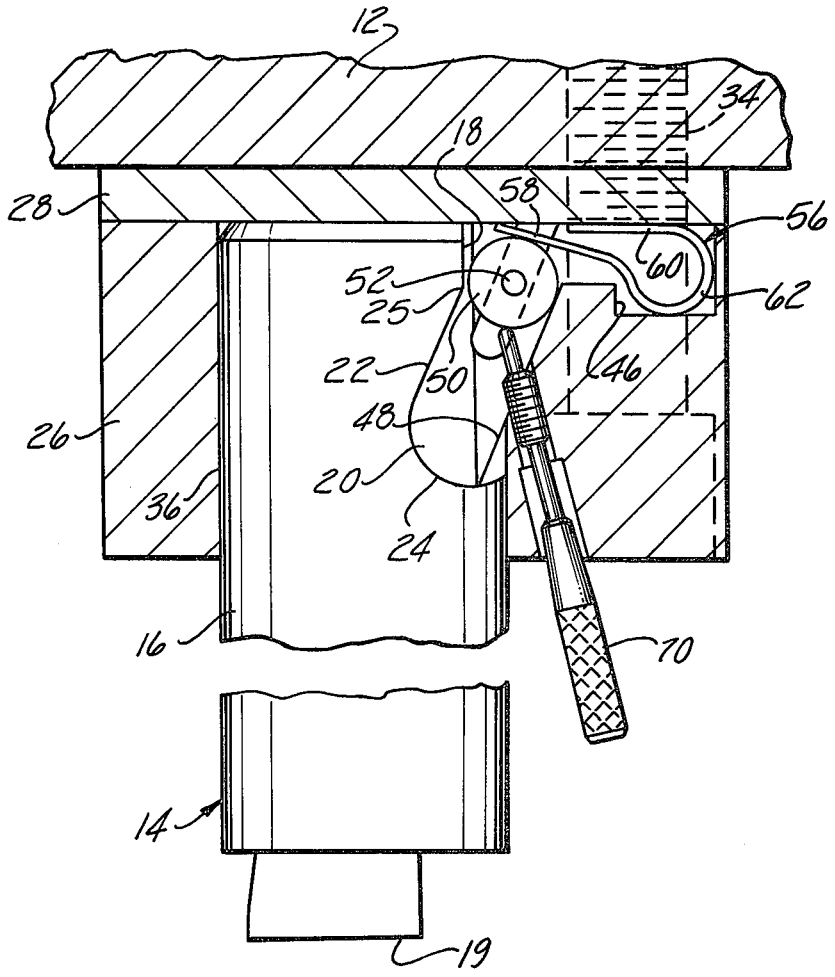
FIG. 3 is a view similar to FIG. 1 and showing the manner in which the punch-engaging latch is displaced for releasing the punch from the retainer.

In FIG. 1 there is shown a punch retainer block 10 mounted on an upper reciprocating die shoe 12. Punch 14 has a generally cylindrical shank 16, the side wall of which is ground with a flat 18 adjacent the upper end of the punch. The lower end of the punch is provided with a non-circular punching portion 19 (FIG. 3) accurately oriented with respect to flat 18. A concavity 20 is formed in the side wall of the punch directly below flat 18. Concavity 20 preferably comprises a flat inwardly inclined face 22, the lower end of which is tangent to an outwardly curved surface 24. The upper end of face 22 intersects the lower end of flat 18 in a straight line 25 which is perpendicular to the vertical axis of the punch.

Figure 2:
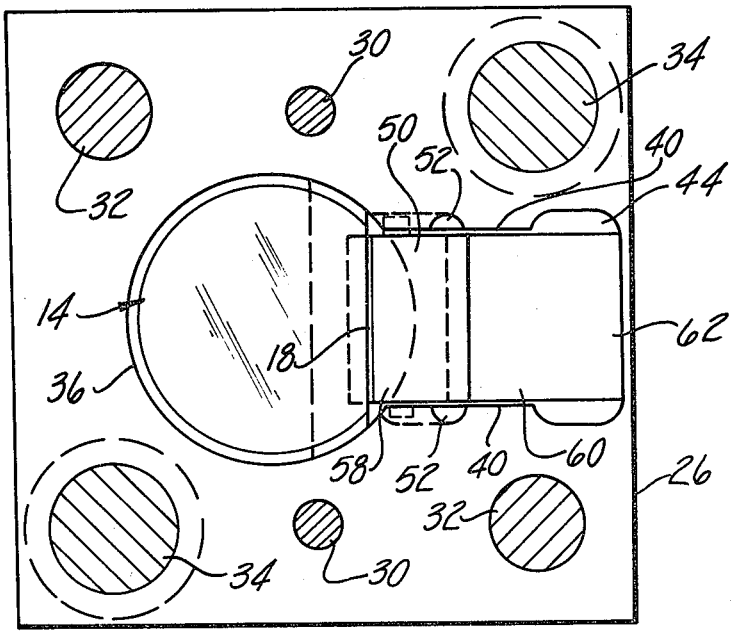
FIG. 2 is a sectional view along the line 2—2 in FIG. 1.

Retainer block 10 comprises a lower body portion 26 and an upper cover plate 28 which are secured together by screws 30 (FIG. 2). Retainer block 10 is accurately located on die shoe 12 by dowel pins 32 and firmly secured thereto by screws 34.

Body 26 of retainer block 10 is formed with an accurately cylindrical bore 36 adapted to snugly receive the shank 16 of punch 14. At one side of bore 36 body 26 is formed with a recess 38 extending downwardly from the top face thereof. The portion of recess 38 which intersects bore 36 is defined by two parallel, vertically extending side walls 40. At the upper end thereof recess 38 is extended laterally outwardly, as at 42, and terminates in a pocket 44 provided with a shoulder 46. Below the lateral extension 42 of recess 38 the recess is formed with an outer side wall 48 which is inclined to the vertical axis of bore 36 so that it converges at least slightly with respect to the inclined face 22 of punch 14. For example, face 22 may be inclined to the vertical at an angle of about 15° and the face 48 of the recess may be inclined to the vertical at an angle of about $22\frac{1}{2}°$ so that the included angle between the two flat faces 22,48 is about $7\frac{1}{2}°$.

The means for retaining punch 14 seated in block 10 comprises a cylindrical roller 50 of circular cross section. At its opposite ends roller 50 is formed with axially projecting stub shafts 52 which loosely engage in inclined slots 54 in the side walls 40 to retain the roller in recess 38. Roller 50 is biased downwardly in recess 38 by a leaf spring 56 of generally flat cross section. Spring 56 comprises a pair of arms 58,60 connected by a return bend 62. Return bend 62 has an arcuate extent of greater than 180° so that in the relaxed position the spring arms 58,60 diverge in a direction away from return bend 62. However, in FIGS. 1 and 3 spring 56 is shown in a compressed condition. Shoulder 46 serves to engage the return bend portion 62 of the spring so as to retain it in position in recess 38. The longer arm 58 of the spring bears downwardly on the top side of roller 50 and the shorter arm 60 of the spring bears against the bottom wall of top plate 28. As shown in FIG. 2, arm 58 of spring 56 extends across the top side of roller 50 throughout substantially the entire length of roller 50. Roller 50 preferably has a length greater than its diameter. Spring 56 is formed and retained by recess 38 so that the tangential line of contact between arm 58 and roller 50 is at all times perpendicular to the axis of bore 36 so that the roller will be oriented by the spring so that its axis is always accurately horizontal.

The retainer body 26 is also formed with an inclined bore 64 extending upwardly from the bottom face of the retainer body and intersecting the inclined face 48 of recess 38. Bore 64 is threaded, as at 66, to accommodate the threaded portion 68 of a tool 70 for releasing roller latch 50 from engagement with the inclined face 22 of punch 14.

The enlarged return bend portion 62 of spring 56 imparts substantially greater resiliency to the spring than would be the case if the two arms 58,60 were simply connected by a V-shaped return bent portion. In addition, spring 56 is relatively strong and, since it bears flatwise against the top side of roller 50 for substantially the entire length of the roller, it exerts a relatively high downward force on the roller. This relatively high force across the entire length of the roller combined with the fact that the roller engages the inclined face 48 of recess 38 maintains the central axis of the roller perfectly horizontal, that is, perpendicular to the vertical axis of bore 36. In addition, spring 56 is sufficiently strong such that, if the line of contact between roller 50 and the inclined face 22 on the punch shank 16 is initially not parallel to the central axis of the roller, the downward force exerted by the spring on the roller will be sufficient to rotate punch 14 about its vertical axis to a position wherein the lines of contact between roller 50 and the inclined faces 22,48 and the axis of the roller will be accurately parallel to each other and accurately perpendicular to the vertical axis of bore 36. Since punch 14 is initially machined so that the non-circular punching end 19 of the punch has a predetermined angular relationship with respect to the inclined face 22 of concavity 20, spring 56 insures that the end 19 of the punch will be in a predetermined position relative to the punch retainer when the punch is fully inserted in bore 36 so that its upper end bottoms against the bottom side of top plate 28.

When it is desired to mount the punch within the retainer, the punch is oriented so that the flat wall 18 at the upper end of the punch is generally aligned with the recess 38. It is then inserted upwardly through the bore 36 of the retainer so that the upper end of the flat 18 engages roller 50. Roller 50 is then displaced upwardly by moving the punch upwardly so as to compress spring 56. Recess 36 is dimensioned such that, when spring 56 is fully compressed with roller 50 adjacent the upper end of the recess, roller 50 still projects radially into bore 36 so that the upper end of the punch can bottom against the under side of the plate 28 only when the flat wall 18 is aligned generally parallel with the axis of the roller 50. Thereafter roller 50 will be urged downwardly by spring 56 into tangential contacting wedging relation with the flat faces 22,48. The punch will thus be firmly retained within the retainer with the non-circular punching end 19 properly oriented. In the event roller 50 is slightly cocked or the punch is not accurately angularly oriented relative to the axis of roller 50, the force of the spring arm 58 acting downwardly on roller 50 will cause the roller to assume a position on face 48 wherein its axis is perpendicular to the vertical axis of the cylinder bore 36. At the same time, the force of the spring is sufficiently great as to cause the roller to rotate the punch about its vertical axis so that the line of contact between the roller and face 22 is also accurately perpendicular to the vertical axis of the punch bore 36.

To remove the punch from within the retainer it is only necessary to thread the tool 70 upwardly through bore 64 sufficiently to displace roller 50 upwardly to a position wherein it clears the flat side wall 18 of the punch. The punch can then be readily retracted. Roller 50 will then be retained in recess 38 by the interengagement of stub shafts 52 within the lower ends of slots 54.

I claim:

1. In combination a punch having a shank of circular cross section and provided with a non-circular punching portion at its lower end, said punch having a flat side wall portion at its upper end and an axially extending, radially inwardly inclined flat wall extending downwardly from the lower end of said upper flat wall portion, and a punch retainer having a circular bore sized to receive said punch with a close fit and having abutment means against which the upper end of the shank of the punch is adapted to bottom when the punch is fully inserted in said bore, said retainer also having a recess therein opening radially into said bore, said recess having a vertically extending flat wall inclined downwardly toward the vertical axis of said bore at an angle slightly greater than the angle of inclination of the inclined wall on the punch, a latch in said recess having a central axis extending transversely of the axis of said bore and diametrically opposed cylindrical surface portions parallel to said axis and adapted to engage with wedging tangential line contact said flat inclined walls of said punch and recess to prevent withdrawal of the punch downwardly through said bore and a leaf spring of flat cross section in said recess having one end portion retained in said recess and its opposite end portion bearing flatwise against the top side of said latch and orienting the latch so that its axis is perpendicular to the axis of said bore and resiliently urging said latch downwardly into said tangential contact with said inclined walls of said punch and recess, said leaf spring being of sufficient strength to urge said latch downwardly against said inclined walls of the punch and recess so as to rotate the punch about its vertical axis in said bore to a position wherein said tangential contact lines are parallel to each other and perpendicular to the vertical axis of the punch, and means limiting radial outward displacement of said latch such that the punch can be inserted in said bore to bottom against said top plate only when the flat side wall portion of the punch is generally radially aligned with said recess, said latch comprising a cylindrical roller having stub shafts projecting axially from the opposite ends thereof, said recess having guide tracks at each side thereof into which said stub shafts project for retaining the roller in said recess.

2. The combination called for in claim 1 wherein said opposite end portions of said leaf spring are connected by a resilient return bend to impart added resiliency to the spring.

3. The combination called for in claim 1 wherein said leaf spring comprises two legs connected by a return bend, said return bend comprising said one end portion of said spring and being retained in a portion of said recess radially more remote from the axis of the bore than the inclined face of the recess.

4. The combination called for in claim 2 wherein said return bend has an arcuate extent of greater than 180° and in the unstressed condition of the spring said legs diverge from said return bend.

5. The combination called for in claim 4 wherein said recess has a portion thereof spaced radially more remote from the axis of the bore than said inclined face of the recess, said return bend being seated in said portion of said recess.

6. The combination called for in claim 5 wherein said portion of said recess has a vertically extending shoulder therein engageable with said return bend to limit displacement of the spring in a direction radially toward said bore.

7. In combination a punch having a shank of circular cross section and provided with a non-circular punching portion at its lower end, said punch having a flat side wall portion at its upper end and an axially extending, radially inwardly inclined flat wall extending downwardly from the lower end of said upper flat wall portion, said inwardly inclined wall having a predetermined circumferential relationship with the non-circular end of the punch, and a punch retainer having a flat top face and a circular through bore sized to receive said punch with a close fit, a flat top plate secured to the top face of the retainer and against which the upper end of the shank of the punch is adapted to bottom when the punch is fully inserted in said bore, said retainer also having a recess therein opening radially into said bore, said recess extending upwardly to the top face of said retainer and being closed at said top face by said top plate, said recess having a vertically extending flat wall inclined downwardly toward the vertical axis of said bore at an angle slightly greater than the angle of inclination of the inclined wall on the punch, a cylindrical roller in said recess having a central axis extending transversely of the axis of said bore and adapted to engage with wedging tangential line contact said flat inclined walls of said punch and recess to prevent withdrawal of the punch downwardly through said bore, said roller having a length greater than its diameter, a leaf spring of flat cross section in said recess having one end portion bearing flatwise upwardly against the underside of said top plate and its opposite end portion bearing flatwise downwardly against the top side of said roller across substantially the entire length of the roller, said end portions of the spring being connected by a return bend, the flatwise engagement of said spring with the top plate and roller serving to orient the roller so that its axis is perpendicular to the axis of said bore and resiliently urging said roller downwardly into said tangential contact with said inclined walls of the punch and recess, said leaf spring being of sufficient strength to urge said roller downwardly against said inclined walls of the punch and recess so as to rotate the punch about its vertical axis in said bore to a position wherein said tangential contact lines are parallel to each other and perpendicular to the vertical axis of the punch and means limiting radial outward displacement of said roller such that the punch can be inserted in said bore to bottom against said top plate only when the flat side wall portion of the punch is generally radially aligned with said recess.

* * * * *